United States Patent [19]

Tomozaki et al.

[11] Patent Number: 4,502,532

[45] Date of Patent: Mar. 5, 1985

[54] FIN-AND-TUBE TYPE HEAT EXCHANGER

[75] Inventors: Ryozo Tomozaki; Takeshi Uchita, both of Mito; Hideo Ide, Katsuta; Misao Suzuki, Hitachi, all of Japan

[73] Assignee: Hitachi, Ltd., Tokyo, Japan

[21] Appl. No.: 593,963

[22] Filed: Mar. 27, 1984

Related U.S. Application Data

[63] Continuation of Ser. No. 352,798, Feb. 26, 1982, abandoned.

[30] Foreign Application Priority Data

Mar. 4, 1981 [JP] Japan ..... 56-29902

[51] Int. Cl.[3] ..... F28F 9/26

[52] U.S. Cl. ..... 165/79; 165/150; 165/151; 165/178; 285/137 R; 285/158

[58] Field of Search ..... 165/150, 151, 79, 153, 165/178, 173, 174, 175; 285/158, 139 R

[56] References Cited

U.S. PATENT DOCUMENTS

| | | | |
|---|---|---|---|
| 1,710,811 | 4/1929 | Dewald | 165/79 |
| 1,926,460 | 9/1933 | Slagel | 165/79 |
| 1,931,467 | 10/1933 | Young | 165/151 X |
| 4,321,911 | 3/1982 | Offutt | 165/175 X |
| 4,458,749 | 7/1984 | Melnyk | 165/175 X |

FOREIGN PATENT DOCUMENTS

| | | | |
|---|---|---|---|
| 113046 | 12/1973 | Japan . | |
| 23061 | 2/1978 | Japan . | |
| 107896 | 8/1980 | Japan | 165/151 |
| 198851 | 6/1923 | United Kingdom | 165/79 |

*Primary Examiner*—Sheldon J. Richter

*Attorney, Agent, or Firm*—Antonelli, Terry & Wands

[57] ABSTRACT

A joint construction for a fin-and-tube type heat exchanger formed of aluminum suitable for use as an evaporator of a cooling system for an automotive vehicle, wherein an end plate near the open ends of tubes is formed with openings larger in diameter than the openings formed in fins to which the tubes are securedly fixed. The joint construction includes a flare formed at the open end of the tube by inserting a tube end flaring punch and restrained by the opening formed in the end plate to be kept from outwardly expanding more than is necessary. Thus the flare produced has high dimensional accuracy and a tube member can be joined to the open end of each tube by brazing with a high degree of accuracy and precision. The brazed joint produced has higher reliability in performance than brazed joints of the prior art. The use of the improved joint construction enables brazing to be carried out automatically and allows a compact size to be obtained in a fin-and-tube type heat exchanger.

3 Claims, 11 Drawing Figures

FIN-AND-TUBE TYPE HEAT EXCHANGER

This is a continuation of application Ser. No. 352,798, filed Feb. 26, 1982, now abandoned.

BACKGROUND OF THE INVENTION

The present invention relates to heat exchangers, and more particularly, to a fin-and-tube type heat exchanger formed of aluminum suitable for use as an evaporator of an air cooling system for automotive vehicles having a joint construction that can be advantageously provided by brazing.

Referring to FIG. 1, a plurality of fins 3 are arranged in superposed relation between upper and lower end plates 1 and 2 in such a manner that the spacing between the fins 3 is kept constant by a plurality of cylindrical flanges 4 provided to each of the fins 3. U-bend tubes 5 extend from the lower end plate 2 through openings formed therein with the same pitch diameter as openings formed in the fins 3 and penetrate the upper end plate 1 through openings similar to those formed in the lower end plate 2, to project upwardly from the upper end plate 1. Each of the U-bend tubes 5 projecting upwardly from the upper end plate 1 has a U-bend tube 6 of smaller length than the U-bend tube 5 joined thereto by brazing, so that the adjacent U-bend tubes 5 are connected together to provide a serpentine passageway for a refrigerant to flow therethrough.

In joining the U-bend tube 6 to the U-bend tube 5, it has been the usual practice to carry out the operation in a manually operated torch brazing process or a furnace brazing process and FIG. 3 shows the shape of a brazed joint produced generally in the art. As shown, an assembly of the U-bend tubes inserted in the openings in the fins 3 is supported on a support 7 which has a bottom of the U-shape of the tube 5 resting thereon, and a rod 8 having a ball is inserted in the tube from its upper end to be force fitted therein, to thereby expand the tube 5 and secure the tube 5 to the upper and lower end plates 1 and 2 in a single operation. At this time, when the ball has reached the lower end of the tube at the lower end plate 2 and tube expansion has made a substantial progress, a tube end flaring punch 9 is inserted in the tube 5, to form a flare 10 at the end. However, the flare 10 is merely formed on the upper end plate 1 and has a shape and configuration which makes it difficult to obtain dimensional accuracy. FIG. 4 shows a tube 6 joined by brazing to the tube 5 formed with a flare of low dimensional accuracy.

SUMMARY OF THE INVENTION

This invention has been developed in view of the fact that if the flare 10 lacks uniformity as shown in FIG. 4, it is impossible to provide a good joint because a gap g between the inner surface of the flare 10 and the tube 6 of U-bend is not suitable for carrying out brazing in good condition and that when there is tilting of the tube 6 or the gap g is too large in size, molten brazing metal will flow out and blowholes will be formed in the joint, with the result that reliability of brazing in providing an airtight seal to the joint will be reduced. Accordingly, it is an object of the invention to provide a joint construction by making alterations to the construction and the process for operation of the prior art, which joint construction enables the operation to be automated for the purpose of obviating the aforesaid disadvantages of the prior art and producing an excellent joint of high reliability in performance at a high yield. More specifically, it is an important object of the invention to provide a fin-and-tube type heat exchanger in which the accuracy and precision with which the U-shaped tubes assembled with the fins are joined to the U-bends to provide a serpentine passageway for a refrigerant to flow therethrough can be increased.

The aforesaid objects of the invention can be accomplished by increasing the diameter of the openings formed at the upper end plate for inserting the U-bend tubes over and above the diameter of the openings formed in the fins for inserting them, and inserting a tube end flaring punch in each U-bend tube in such a manner that a flare formed at the end of each U-bend tube extends into the associated opening formed in the upper end plate, so that the flare formed at the end of the U-bend tube tending to freely expand outwardly in the openings in the upper end plate can be restrained at its outer periphery to keep it from further expanding more than is necessary.

DESCRIPTION OF THE PREFERRED EMBODIMENT

Figure 1:
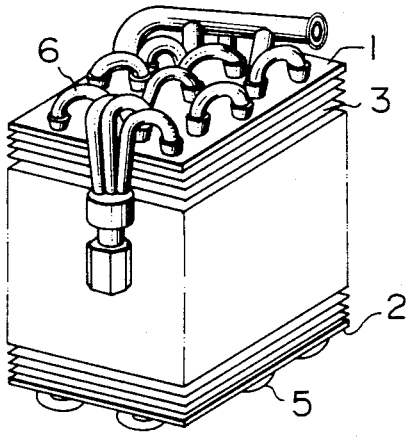
FIG. 1 is a perspective view of the whole of a fin-and-tube type heat exchanger formed of aluminum in which the present invention can be applied.
Figure 2:
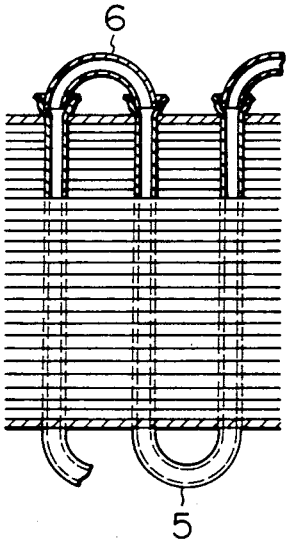
FIG. 2 PRIOR ART
FIG. 2 is a fragmentary sectional view, on an enlarged scale, of a fin-and-tube type heat exchanger of the prior art.
Figure 3:
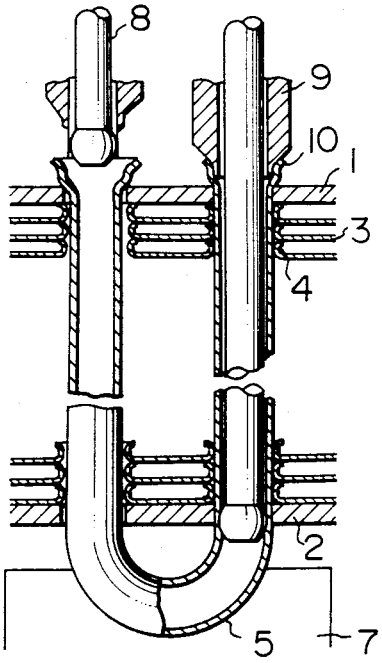
FIG. 3 PRIOR ART
FIG. 3 is a sectional view of the U-bend tube of the prior art, showing the manner in which a flare is formed at the end of the tube.
Figure 4:
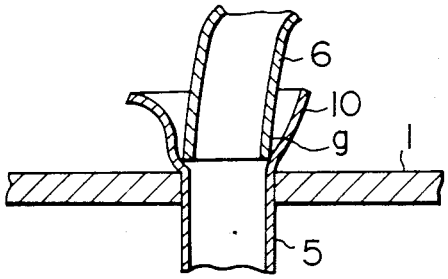
FIG. 4 PRIOR ART
FIG. 4 is a sectional view of a tube having a flare formed by a process of the prior art having a U-bend joined thereto.
Figure 5:
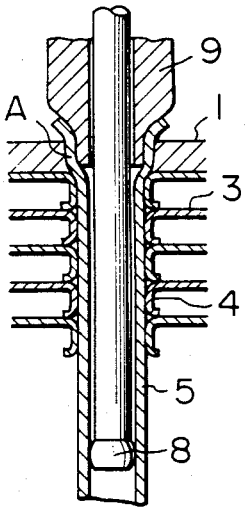
FIGS. 5 and 6 are sectional views showing the essential portions of one embodiment of the fin-and-tube type heat exchanger in conformity with the invention.
Figure 6:
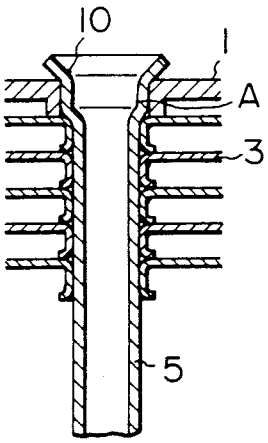
Figure 7:
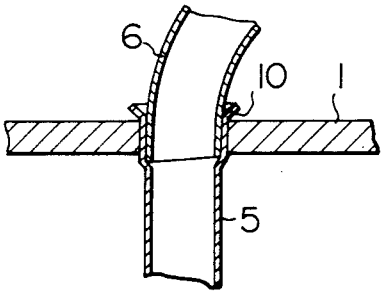
FIG. 7 is a sectional view showing the manner in which a U-bend is joined to the flare shown in FIG. 6.

As shown in FIGS. 5 and 6, a plurality of cooling fins 3 are placed in superposed relation and the upper and lower end plates 1 and 2 are located above and below the stack of cooling fins 3, to allow the U-bend tubes 5 to extend through the openings formed in the fins 3 as well as the upper and lower end plates 1 and 2, as is the case with the prior art heat exchanger of the fin-and-tube type shown in FIGS. 2 and 3. A tube expanding punch 8 expands each U-bend tube 5 to securely attach the fins 3 thereto, and a tube end flaring punch 9 forms a flare 10 at the end of the U-bend tube 5 to provide a brazed joint thereto. In the embodiment shown and described hereinabove, the openings formed at the upper end plate 1 are larger in diameter than the openings formed in the fins 3. Thus, the flare 10 formed at the end of the tube 5 is restrained and confined to the opening in the upper end plate 1 and includes a section A of the tube 5 in which it is linear in cross section, as shown in FIG. 6.

The process for producing an expanded tube portion with a high degree of precision will be described by referring to FIG. 5. A tube expanding punch 8 having a ball is inserted in the U-bend tube 5 at its end to fix the fins to the tube 5. For example, as shown in FIG. 3, when the ball has reached the lower end plate 2, the tube end flaring punch 9 may be moved downwardly to form the flare 10 shown in FIG. 6. The upper end plate 1 is secured to the tube 5 by insertion of the tube end flaring punch 9 in the U-bend tube 5.

The tube end flaring punch 9 has an outer diameter which is such that the U-bend tube 6 can be suitably fitted in the flare 10 and an optimum gap is provided at the flare 10 for effecting brazing. As one example, when the tube 5 had an outer diameter of 8 mm and a thickness of 0.6 mm, the openings formed at the upper end plate 1 had a diameter of 9.4 mm and the tube end flaring punch 9 had an outer diameter of 8.5 mm. In this example, it was possible to precisely fit a U-bend to the flare of the U-bend tube and yet to provide an optimum gap between the U-bend and the flare to enable brazing to be effected. The optimum gap range is between 0.05 and 0.15 mm. In actual practice, automatic furnace brazing is carried out as follows. A brazing metal in the form of a ring is fitted over the U-bend 6 which is inserted in the flare 10 of the U-bend tube 5 and the assembly is placed in a continuous treatment furnace set at a brazing temperature after a brazing flux is applied to the assembly, so that brazing can be carried out. When the assembly was prepared in the same manner as described by referring to the embodiment of the invention, it was possible to obtain a brazed joint of high performance with minimized blowholes without the molten brazing metal flowing out of the joint.

Figure 8:
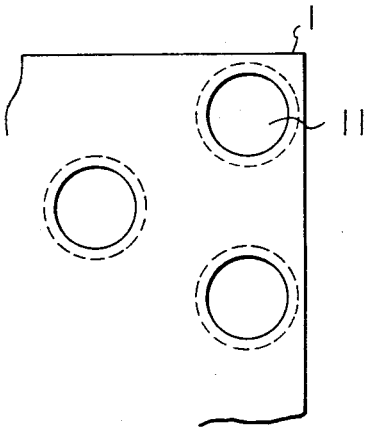
FIG. 8 is a plan view of the upper end plate shown in FIGS. 5 and 6.
Figure 9:
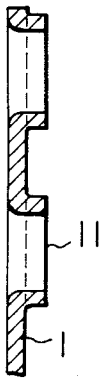
FIG. 9 is a sectional side view of the upper end plate shown in FIG. 8.

FIGS. 8 and 9 show the upper end plate 1 used in the embodiment shown and described hereinabove. When the upper end plate 1 has a small thickness, burring is relied on for forming openings in the upper end plate 1 as indicated at 11. Burring enables a linear fitting portion to be obtained and increases the rigidity of the upper end plate. Thus burring makes it possible to reduce the thickness of the end plates of the heat exchanger.

In a tube end flaring process of the prior art, it has not been possible to form a flare of high precision at the end of the U-bend tube. This has made it impossible to obtain an optimum gap between the flare of the U-bend tube and the U-bend for effecting brazing, so that the brazed joint produced has been low in reliability in providing an air-tight seal by brazing. This tube end flaring process is thus unsuitable not only for carrying out brazing by a manual torch brazing process but also for carrying out brazing by an automatic brazing process requiring a higher precision in the gap for effecting brazing. The result of this is that many defective brazed joints have been produced as by ineffective brazing metal supply. The construction of a brazed joint which increases the precision with which the U-bend is fitted in the flare formed at the end of the U-bend tube enables reliability of a brazed joint to be increased and allows brazing to be performed automatically by obviating the aforesaid problems of the prior art. An automatic brazing operation will be described.

Figure 10A:
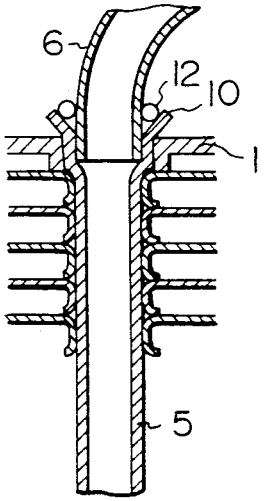
FIG. 10A shows a brazing metal in a form of ring is fitted over the U-bend.
Figure 10B:
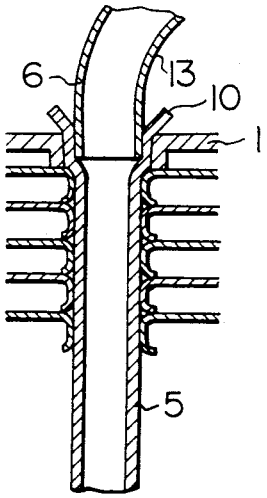
FIG. 10B is a sectional view showing a U-bend clad beforehand with brazing metal.

A flare of high dimensional accuracy as indicated at 10 in FIG. 6 is formed. A brazing metal 12 (which is usually an Al-Si alloy) in the form of a ring is fitted over the U-bend 6 as shown in FIG. 10A, and a brazing flux is applied thereto. The assembly is placed in a furnace and heated to effect brazing. The furnace may be either a batch type or a mass production type. Heating may be carried out in the air, dried air or $H_2$ gas. The trouble of fitting the ring-shaped brazing metal over the U-bend may be eliminated by having the U-bend clad beforehand with a brazing metal (Al-Si alloy) of a thickness of 10–20$\mu$, as indicated at 13 in FIG. 10B. Also, by using a U-bend in the form of a cladding having a layer of brazing metal containing Mg in accordance with U.S. Pat. No. 3,337,482, it is possible to produce a brazed joint by means of vacuum brazing using no flux. The brazed joints produced by these processes are sound and free from defects that might otherwise be produced by ineffective supply of brazing metal, and reliable in performance.

In the embodiment shown and described hereinabove, the flare 10 is formed in the U-bend tube 5 along the inner surface of the opening 11 formed in the upper end plate 1, and has a linear fitting portion of a length equal to the thickness of the upper end plate 1, so that the flare 10 has markedly improved dimensional accuracy. The provision of the linear fitting portion enables an ideal wedge-shaped brazing gap to be provided between the inner surface of the flare 10 and the outer surface of the U-bend tube 6 by suitably selecting the tapering of the tube end flaring punch 9. Thus it is possible to produce a brazed joint of high reliability in performance because no outflow of the brazing material occurs during the brazing operation and the blowholes are minimized in the joints produced. Moreover, the flare 10 formed at the end of the U-bend tube 5 penetrates deep into the upper end plate 1, so that the U-bend 6 can be inserted deep into the upper end plate 1. This enables a compact size to be obtained in a heat exchanger of the fin-and-tube type. The aforesaid construction of the flare 10 of the fin-and-tube types heat exchanger can be used with evaporators, condensers, radiators, oil coolers, heater cores, etc.

From the foregoing description, it will be appreciated according to the invention, a flare is formed at the end of a U-bend tube in such a manner that its outward expansion more than is necessary is restrained and the flare is confined to the opening formed in the upper end plate, so that a brazed joint produced between the U-bend tube inserted in the fins and a U-bend fitted in the flare can have high reliability in performance because the U-bend tube fitted in the flare and the U-bend to be connected thereto can be fitted together with a high degree of accuracy and precision.

What is claimed is:

1. A joint construction of a fin-and-tube type heat exchanger comprising an upper end plate, a lower end plate, a plurality of fins disposed in a superposed relationship in layers between the upper end plate and the lower end plate, a plurality of tubes which may be either straight or bent in a U-shaped form, and a plurality of tube members each connected to one of said plurality of tubes at open ends thereof, said plurality of tubes are inserted in openings formed in the upper and lower end plates and fins and are expanded so as to bring the tubes into intimate contact with the fins and securedly clamp them together, each of said tube members is joined to one of said plurality of tubes at the end, each of said tubes project beyond an upper surface of the upper end plate and are formed with a flared portion, each of said tubes includes a straight portion which is expanded for securely fixing the same to the upper end plate and an inner surface fitted to the outside of said tube members in said upper end plate, the ends of said tube members are inserted in said straight portions of the tubes and portions between said tube members and a lower inside portion of the flared portions are braze jointed.

2. A fin-and-tube type heat exchanger as claimed in claim 1, wherein said openings formed in the end plate near the open ends of the plurality of tubes are subjected to burring.

3. A joint construction of a fin and tube type heat exchanger as claimed in claim 1, wherein a gap range between said straight portion of said tube in said upper end plate and the outside of said tube member is between 0.05 and 0.15 mm.

* * * * *